United States Patent [19]

Crow et al.

[11] Patent Number: 4,469,179

[45] Date of Patent: Sep. 4, 1984

[54] SAFETY SYSTEM

[75] Inventors: Robert W. Crow, Irving; Michael B. Vinzant, Carrollton; Kenneth L. Schwendemann, Lewisville, all of Tex.

[73] Assignee: Otis Engineering Corporation, Dallas, Tex.

[21] Appl. No.: 331,641

[22] Filed: Dec. 17, 1981

[51] Int. Cl.[3] ..... E21B 34/10

[52] U.S. Cl. ..... 166/319; 166/375; 166/323

[58] Field of Search ..... 166/72, 316, 319, 322, 166/323, 375, 386

[56] References Cited

U.S. PATENT DOCUMENTS

| | | | |
|---|---|---|---|
| 3,744,564 | 7/1973 | Mott | 166/322 |
| 3,799,258 | 3/1974 | Tausch | 166/323 |
| 3,865,141 | 2/1975 | Young | 166/322 |
| 3,882,935 | 5/1975 | Calhoun | 166/323 |
| 3,886,967 | 6/1975 | Nelson | 166/323 |
| 4,077,473 | 3/1978 | Watkins | 166/323 |
| 4,249,599 | 2/1981 | Krause | 166/322 |

*Primary Examiner*—Stephen J. Novosad
*Assistant Examiner*—William P. Neuder
*Attorney, Agent, or Firm*—Vinson & Elkins

[57] ABSTRACT

A well controlled by two hydraulically operated subsurface safety valves made up in the tubing string. A first valve is mechanically locked in open position and the second valve is utilized to control flow through the string. Upon malfunction of the second valve it is locked in open position and the first valve is released from its locked open position and is utilized to control flow through the string.

3 Claims, 17 Drawing Figures

Figure 1:
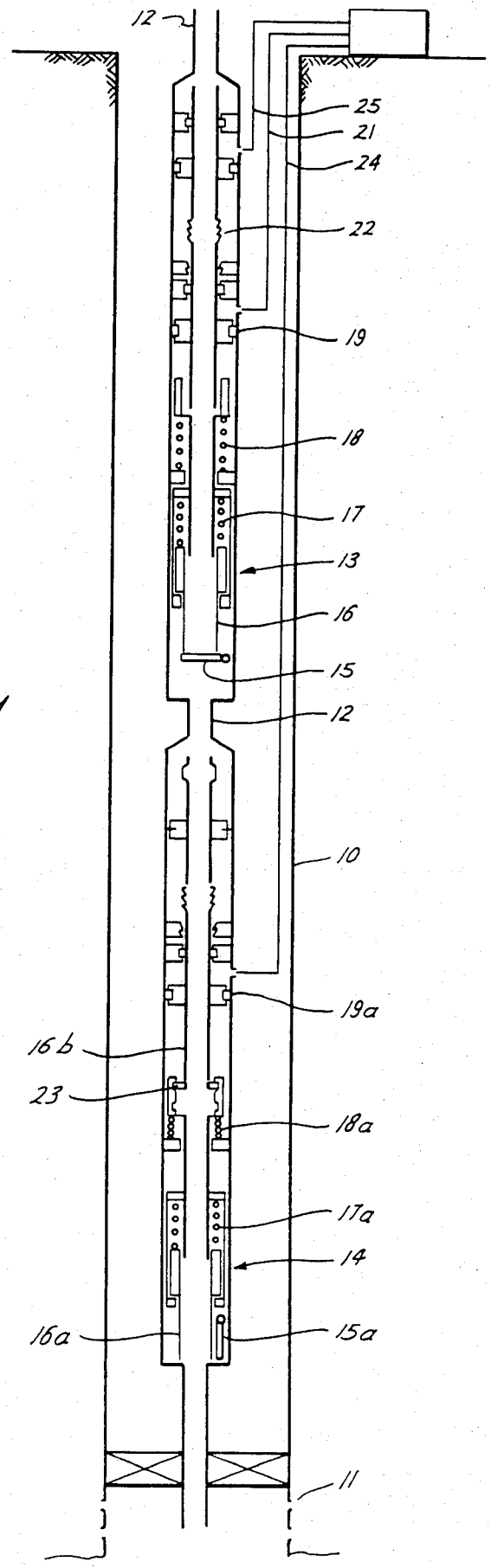

49
51
51
48
52
33
44
32
45
54
46
44
53
43
49
47
31

SAFETY SYSTEM

This invention relates to control of wells and, more specifically, to control of wells by surface controlled subsurface safety valves.

Subsurface safety valves are in general service to protect wells and to automatically close upon the happening of certain occurrences to shut in the well.

It sometimes occurs that these valves malfunction for various reasons.

In many instances it is preferred to use a safety valve of the type made up as a part of the tubing as a maximum flow area can be obtained in this manner. However, when the safety valve malfunctions, the valve must be pulled and repaired or replaced, or locked open and bypassed. In the past the valve has sometimes been locked open and a wireline safety valve positioned in the tubing to provide the control of flow. See Taylor U.S. Pat. No. 3,696,868.

It is an object of this invention to provide method and apparatus for utilizing successively, plural subsurface safety valves made up as a part of a tubing string to control flow through the tubing.

Another object is to provide method and apparatus for utilizing plural subsurface safety valves made up as a part of a tubing string in which one valve is mechanically locked in the open position while a second valve is used to control the well and upon malfunction of the second valve the second valve is locked in open position and the first valve is released from open position and utilized to control flow through the well.

Another object is to provide method and apparatus as in the preceding objects in which the valve which is locked in open position is rendered operative by pressurizing the control line for such valve.

Another object is to provide a method and apparatus as in the preceding objects in which after the back up valve has been released and rendered operative, it may in turn be mechanically locked in open position and a wireline valve run to control flow through the tubing.

Other objects, features and advantages of the invention will be apparent from the drawings, the specification and the claims.

In the drawings wherein like reference numerals indicate like parts and wherein an illustrative embodiment of this invention is shown:

FIG. 1 is a schematic view of a well installation employing dual subsurface safety valves made up as a part of the tubing string;

FIGS. 2A, 2B, 2C, and 2D are continuation views in quarter-section of the primary valve of the system shown in FIG. 1 with the valve member locked in open position;

FIGS. 3A, 3B, 3C, and 3D are continuation views in quarter-section of the primary valve of the system shown in FIG. 1 with the valve member in closed position;

FIGS. 4A, 4B, 4C, and 4D are quarter-section continuation views of the secondary valve of FIG. 1 showing the valve temporarily latched in open position;

FIGS. 5A, 5B, 5C, and 5D are continuation views in quarter-section showing the secondary valve of FIG. 1 in closed position.

In practicing the method of this invention, a plurality of subsurface safety valves are made up as part of a tubing string and run into the well with the customary control lines extending from each valve to the surface to control operation of the valves. The primary valve when run will be in operative condition.

The secondary valve when run will be mechanically latched in open position and non-functional. The mechanical latch may take any desired form and may be released in any desired manner, as by pressuring up the operative piston for the valve or by running a wireline tool into the well to release the latch.

Upon malfunction of the primary valve it is mechanically latched in the open position. The mechanical latch may be operated either by pressure through a separate control line or may be accomplished with mechanical techniques.

Either before or after the malfunction primary valve has been latched in the open position, the secondary valve has its releasable latch deactivated, either mechanically or by pressure, to permit it to be operated in the normal manner to control flow through the string.

Preferably, the secondary valve is also provided with a latch system for latching it in the open position after malfunction to permit a wireline valve to be run in and landed in the system to control flow through the tubing after both the primary and secondary valves have malfunctioned.

Referring now to FIG. 1, a well having casing 10 is perforated at 11. A tubing 12 is hung in the well and a primary valve 13 and a secondary valve 14 are made up as a part of the tubing string with the valve 13 initially controlling flow through the tubing and the secondary valve 14 being locked in the open position. Provisions are provided for locking the primary valve in open position and for releasing the latch of the secondary valve to permit the secondary valve to control flow through the tubing.

Referring first to the primary valve 13, flow through the valve is controlled by the flapper valve member 15 which is moved between open and closed position by the valve operator 16. The valve operator 16 is biased towards open position by a spring 17 and towards closed position by spring 18 which urges piston 19 upwardly. With piston 19 in its upper position, the two springs 17 and 18 reach equilibrium position with the valve operator 16 in an out of the way position permitting valve 15 to move to closed position. When pressure is applied through the conduit 21 to the piston 19, the springs 17 and 18 are compressed and move the valve operator 16 to open position if the differential across the flapper valve 15 permits. If the differential does not permit, the differential across the valve 15 will prevent the operator from moving down until the differential is relieved, as by pressuring up the tubing above the valve. At this time the operator 16 will move downwardly and open valve 15. For a full disclosure of this type of construction and operation, see U.S. Pat. No. 3,865,141.

A mechanical latch means 22 is provided in valve 13 and upon malfunction of the valve 13 the mechanical latch 22 is moved downwardly to a position to mechanically latch the operator 16 in a position to hold the valve 15 in open position. The mechanical latch may be actuated in any desired manner such as by wireline procedures or as will appear hereinafter, a hydraulic system may be provided.

Referring now to the secondary valve 14, it will be seen to be very similar in construction to valve 13 having a flapper valve **15*a*, the two springs 17*a* and 18*a*, and the valve operator 16*a*. The valve operator 16*a* is as in the case of the primary valve a two-piece operator to permit the spring 17*a* to function. Additionally in the secondary valve the upper end of the valve operator 16***a* is telescoped with a still third section of the valve operator 16*b*. This telescoped section 16*b* is releasably latched to the valve operator 16*a* in any desired manner, as by a shear pin, C-ring, or the like. When thus latched, the telescoping parts are in their extended position so that the piston 19*a* is in its full uppermost position and the valve operator 16*a* extends downwardly to a position to prop the valve 15*a* in open position.

Upon failure or malfunction of the primary valve 13, pressuring up of conduit 24 to move piston 19*a* downwardly will release the latch 23 so that actuator 16*b* may now be engaged by the upper end of valve actuator 16*a* and the valve actuator moved upwardly to permit valve 15*a* to close in the absence of pressure urging the piston 19*a* downwardly. When piston 19*a* is pressurized, the piston exerts a force on the valve actuator 16*a* to move it downwardly and prop the valve 15*a* in open position.

In operation the system is run with the secondary valve 14 propped in open position and the primary valve 13 operative. Upon malfunction of primary valve 13, the valve is locked in open position by pressuring up conduit 25 to activate the latch 22 and lock the valve operator in down position to prop flapper valve 15 open. Pressure is applied to conduit 24 to deactive latch 23 and permit the valve 14 to become operational. Valve 14 will now open and close in response to pressure conditions across the piston 19*a*.

Referring now to FIGS. 2A, 2B, 2C, 2D, and FIGS. 3A, 3B, 3C, and 3D, a form of primary valve 13 is illustrated.

The valve body includes a lower sub 26, a valve housing 27, connector 28, a lower spring housing 29, a connector 30, an upper spring housing 31, a piston housing 32, and an upper sub 33.

A valve member 34 is mounted in the housing and may take any desired form. While a flapper valve is shown, it will be appreciated that a ball valve could be substituted in form.

The valve operator is made up of four telescoping sections. The lower valve opening section 35 is biased downwardly by the spring 36 which bears against the upper end of the section 35. The upper end of spring 36 bears against a shoulder provided by a connector 37 which connects two tubular sections which provide an intermediate telescoping section of the valve operator 38. Extending downwardly from this connector 37, is an external sleeve 39 which terminates in a stop 41 which in its upper position engages the shoulder 35*a* on the lower actuator section 35 to withdraw the section 35. With the central section of the valve operator 38 in its upper position, the stop member 41 lifts the lower section of the valve operator 35 into an out of the way position and permits the valve to close. With this intermediate section 38 of the valve operator in its down position the lower valve opening portion 35 of the operator is also down, as shown in FIG. 2. However, if in attempting to open a valve it was found that a substantial pressure differential existed across the valve, the spring 36 would collapse permitting the intermediate section of the operator 38 to move downwardly while the valve 34 remained closed until such time as the pressure differential is relieved, as by pressuring up the tubing above the valve so that the valve may be opened under controlled pressure conditions and an excess force will not be applied to the valve member during the opening operation.

Above the connector 30, the upper spring 42 urges the intermediate section 38 of the valve operator in an upward direction by bearing on a sleeve 43 which provides a part of the intermediate section 38 of the valve operator. Telescoped within this sleeve 43 is the upper section 44 of the valve operator. This upper section 44 carries the operating piston 45. Thus, pressurizing of conduit 46 applies pressure to the top of the piston 45 moving the upper section 44 of the operator downwardly into engagement with the shoulder 47 on the intermediate section 38 of the valve operator to drive the intermediate section of the operator downwardly against the force of spring 42. When pressure is removed from the conduit 46, the spring 42 returns the valve operator to the upper position.

The telescoping connection between the upper section 44 of the valve operator and the intermediate section 38 of the valve operator permits fluid to be pumped downwardly through the valve to pump the valve open without having to pump against the pressure effective on the underside of piston 45. This telescoping connection will permit the valve to be moved to open position while the piston 45 remains in its uppermost position.

Above the uppermost portion 44 of the valve operator there is provided a mechanical lockout in the form of a sleeve 48 which has ratchet teeth on its exterior at 49 to engage ratchet locks 51. This lockout sleeve has an internal key configuration at 52 which may be engaged by wireline tools to drive the lockout sleeve downwardly to in turn drive the piston 45 downwardly and lock the valve operator in valve open position. Also there may be provided above the lockout sleeve 48 a piston 53 which bears against the top of the sleeve 48 and by pressuring up the conduit 54, the piston 53 is driven downwardly and the lockout sleeve 48 is in turn driven downwardly to lock the valve operator in open position.

In operation of the primary valve shown in FIGS. 2 and 3, the valve is run in operative condition and when no pressure is exerted on the conduit 46, the flapper valve will be closed as shown in FIG. 3. Pressurizing conduit 46 pressurizes and moves downwardly piston 45 to engage the upper operator 44 with the intermediate operator 38 and compress the spring 42. As the intermediate operator 38 moves downwardly, it also compresses spring 36 and exerts a downward force on the lower valve operator 35 which bears against the flapper valve 34. In the absence of a pressure differential, the valve operator will move downwardly to the position shown in FIG. 2 to open the valve. If a sufficient differential is present, the spring 36 will collapse and the flapper 34 will not open until the differential across the valve has been reduced to the extent that the spring 36 can overcome the differential and move the flapper 34 to open position.

Figures 2A, 2B, 3A, 3B:
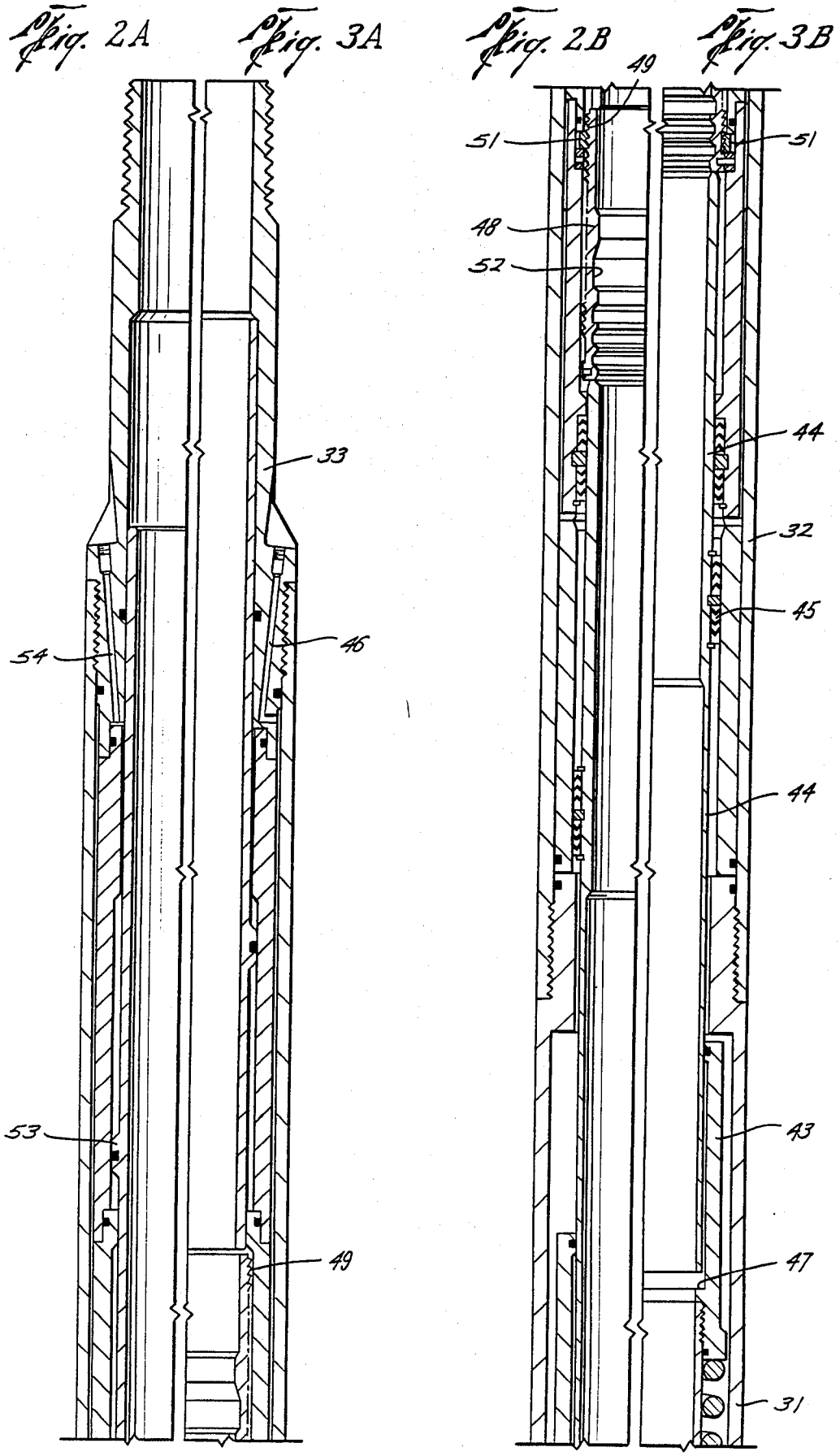
Figure 2C:
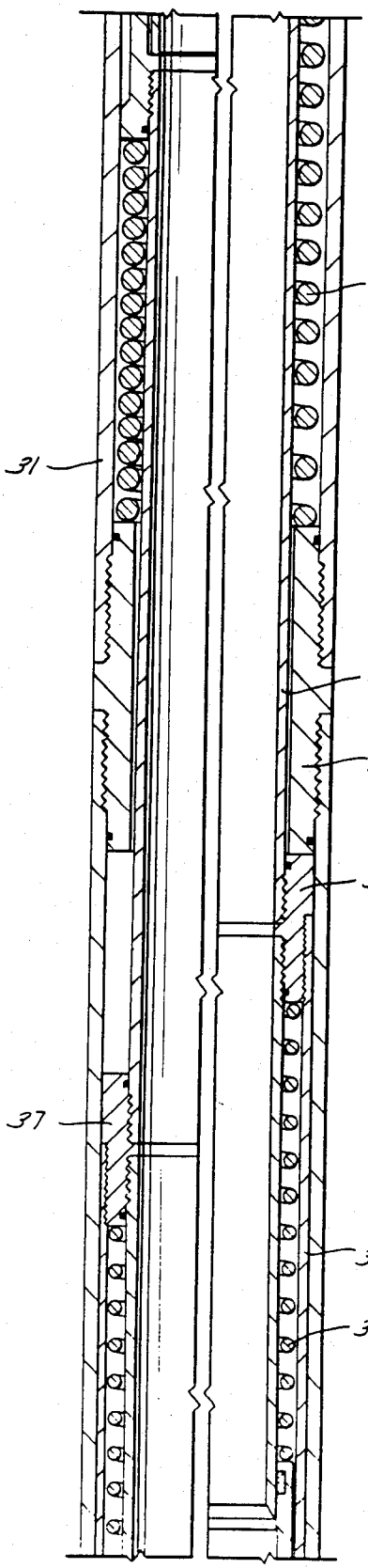
Figure 3C:
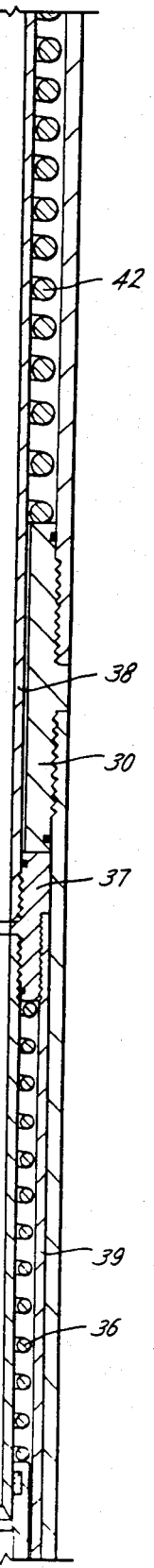
Figure 2D:
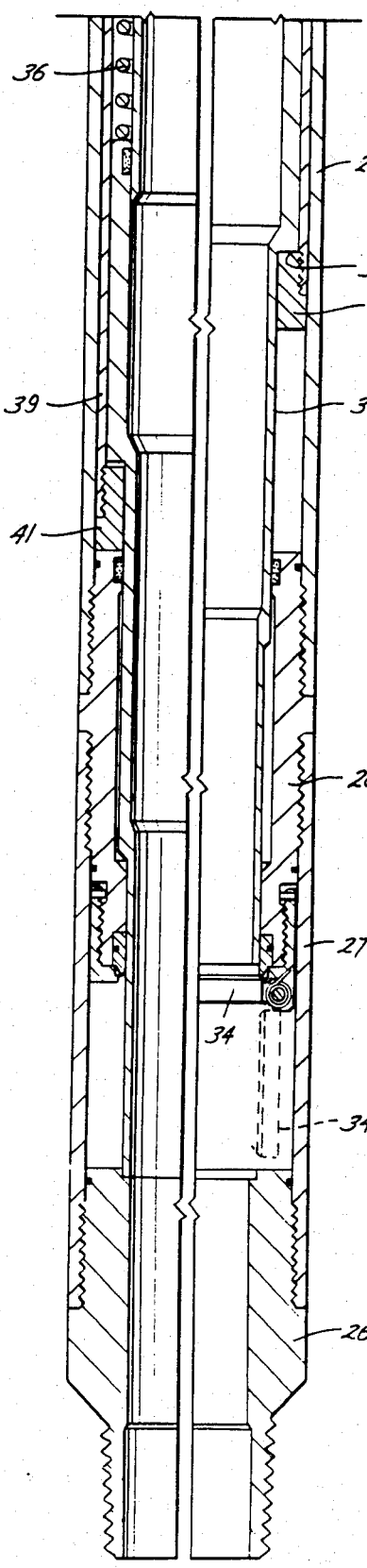
Figure 3D:
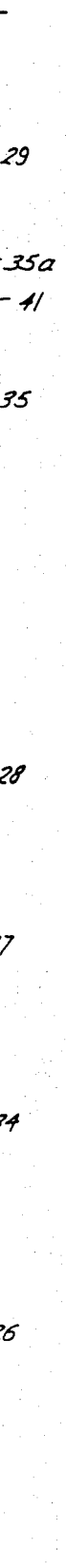

When it is desired to lock the primary valve open piston 53 is pressurized to its lower position, as shown in FIG. 2A, to lock the valve in open position.

Figures 4A, 5A:
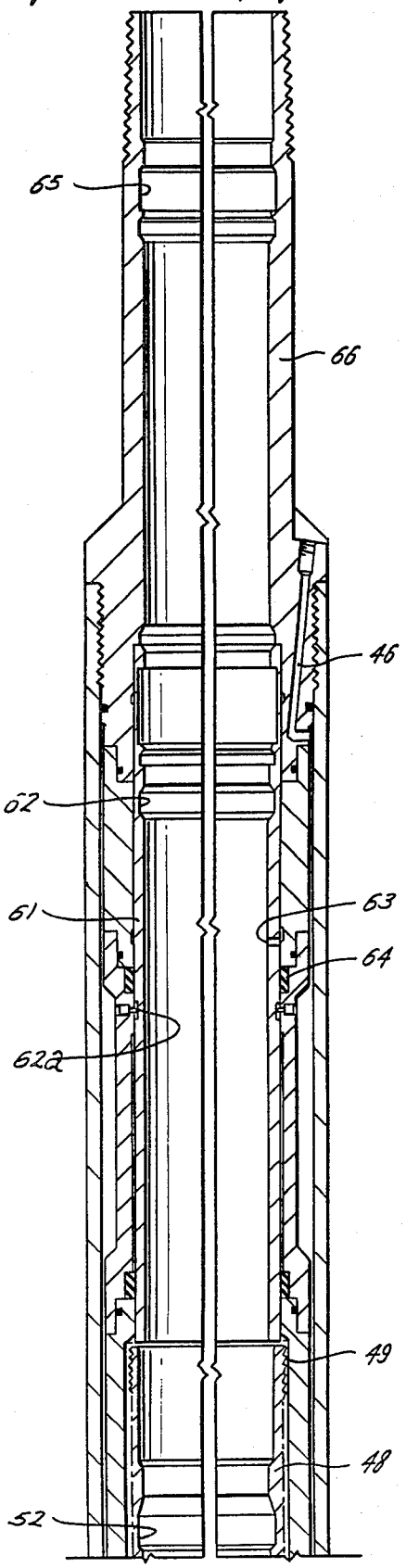
Figures 4B, 5B:
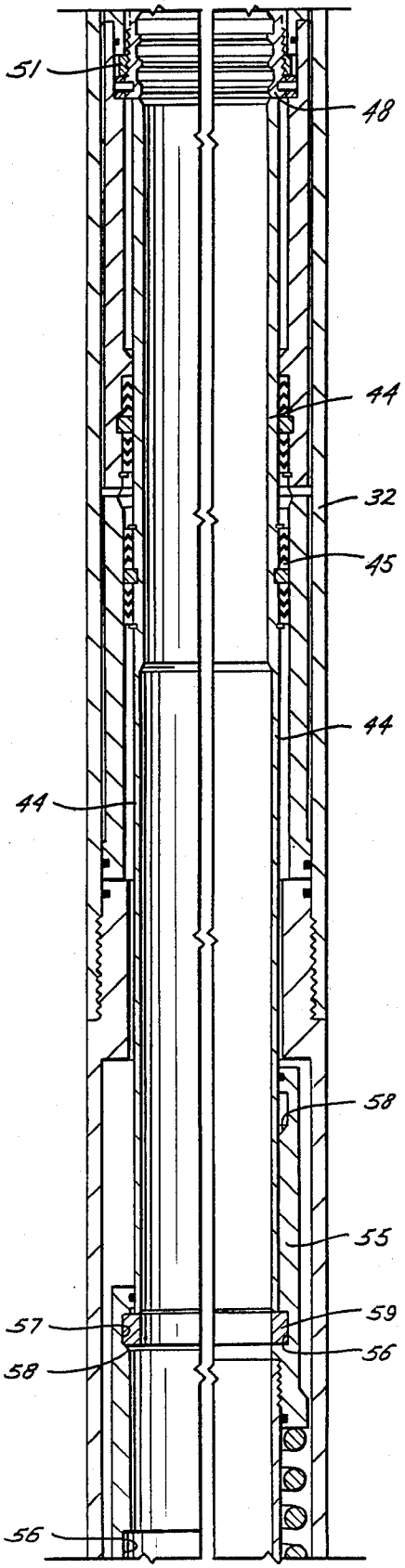
Figures 4C, 4D, 5C, 5D:
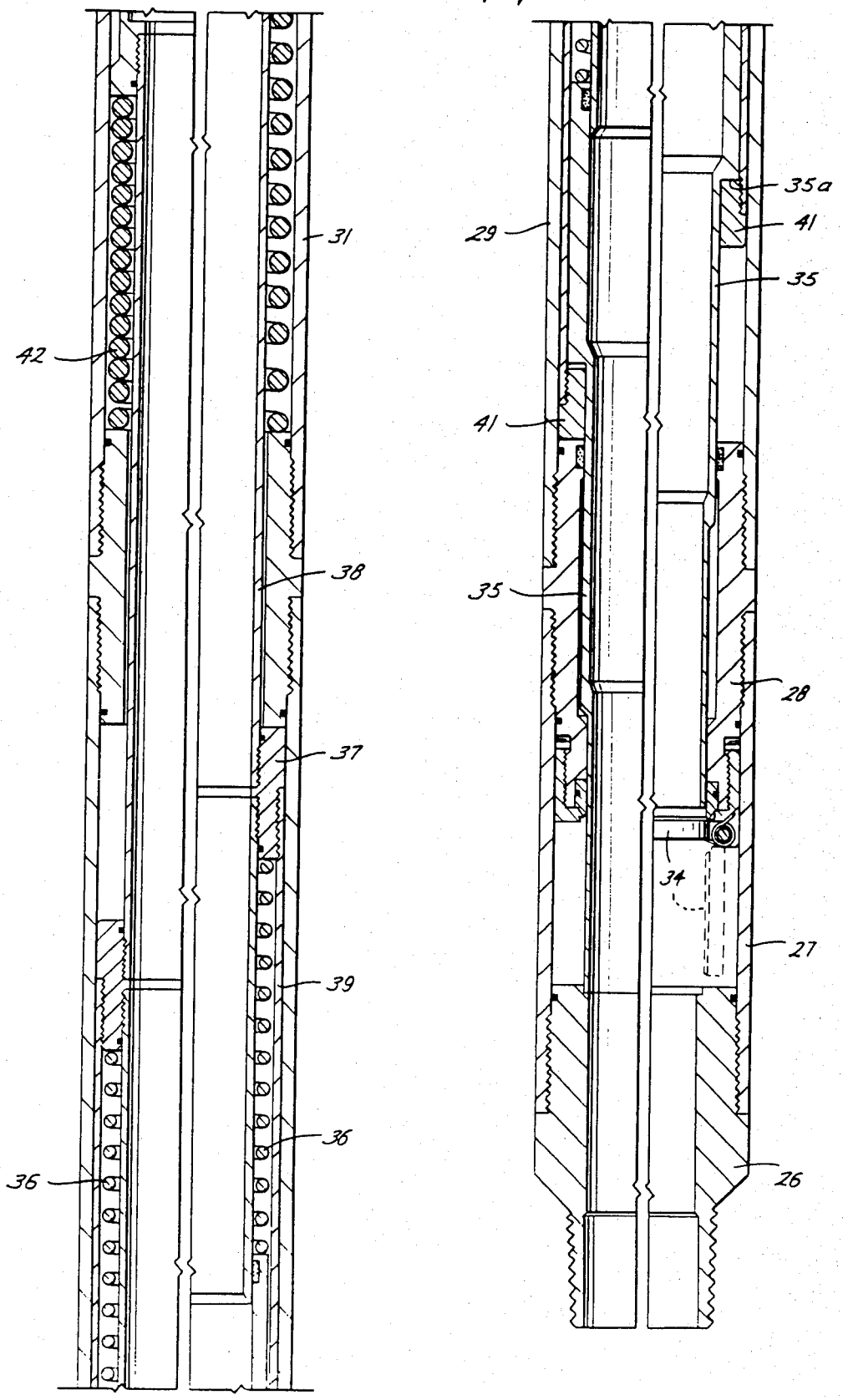

The physical construction of the secondary valve shown in FIGS. 3 and 5 is identical to the primary valve shown in FIGS. 2 and 3 with the exception of two areas. In the upper area of the valve the provision for hydraulically moving the ratchet latch to valve lock position is omitted. The sleeve 55 is substituted for sleeve 43 on the upper end of the intermediate section of the valve operator. This sleeve has adjacent its lower end, a square shoulder groove 56 and at its upper end a groove 57 having a downwardly facing square shoulder and an upwardly facing chamfered shoulder 58. A split snap ring 59 is movable between these two grooves, as illustrated in comparing FIG. 4B and FIG. 5B. With the snap ring in the upper groove 57, as shown in FIG. 4, the upper section 44 of the valve operator is held in extended position and this upper section of the valve operator is in its uppermost position limited by the lower face of the lockout sleeve 48 which provides an abutment for the upper actuator section 44. With the telescoping parts provided by the upper actuator 44 and the sleeve section 55 of the intermediate operator section 38 extended as in FIG. 4B, the upper spring 42 is collapsed and the lower section 35 of the valve operator is in its down position propping the valve member 34 in open position. When upper actuator 44 is driven downwardly to collapse the C-ring 59 and drive it into the lower groove 56, as shown in FIG. 5B, the actuator section 44 now rests upon the C-ring 59 which is substituted for the shoulder 47 of the FIG. 2 and FIG. 3 primary valve and the valve is now in operative position and will open or close upon the application or removal of pressure against the piston 45.

In lieu of the lockout sleeve operator piston 53 of the primary valve, there is provided in the upper position of the secondary valve provisions for landing a wireline valve in the event both the primary and secondary valve have malfunctioned. For this purpose, a sleeve 61 is provided in the upper portion of the valve having key receiving grooves 62 which may be engaged by a wireline tool to drive the sleeve 61 downwardly. The sleeve 61 bears upon the lockout sleeve 48 and in moving downwardly will move the sleeve and the valve operator to the valve lockout position. In moving downwardly, the plugs **62*a* will shear and the port 63 in the sleeve 61 will pass over the seal 64 and pressure fluid introduced through the controlled conduit 46 can now pass through the sheared plug 62*a* and port 63 into the interior of the tool. By landing a wireline subsurface safety valve in the landing nipple provided at 65 in the upper end of the upper sub 66 and in the conventional manner providing seals on the wireline valve to bridge across the port 63**, the tubing may now be controlled by a wireline subsurface safety valve.

In the operation of the secondary valve it will be run with the latch means between the telescoping parts of the valve operator latching these parts in extended position as by the C-ring 59 or any other releasable latch mechanism. In this condition the flapper valve 34 is held in its open position. When it is desired to activate the valve, the latch means may be released in any desired manner. Preferably it is readily released by pressuring up piston 45 to drive the upper telescoping section 44 of the valve actuator, downwardly relative to the intermediate section 38 to telescope these two parts together driving the latch downwardly into the square shoulder groove 56, to permit the spring 42 to expand when the pressure is removed from the piston 45 into the condition shown in FIG. 5B. After release of the latch, the secondary valve is operable and when pressure is not applied to piston 45, the flapper 34 will move to its close position. When pressure is applied, the upper section 44 and intermediate section 38 of the valve actuator move as one as the have now telescoped or collapsed inwardly relative to each other to where the upper section 44 bears on the C-ring 59. Pressure on the piston will drive the intermediate section of the valve opening downwardly as shown in FIG. 4. When the pressure differential across the flapper valve 34 permits the spring 36 will expand and drive the lower section 35 of the valve actuator downwardly to move the valve 34 to open position as shown in FIG. 4.

While preferred forms of primary and secondary valves are illustrated it will be appreciated that other forms of valves could be utilized in carrying out this invention. It only being required that the secondary valve be capable of being temporarily latched open while the primary valve is being utilized and that the primary valve be latched open while the secondary valve is being used. For instance, forms of valves are known which may be releasably latched in open position and they might be utilized instead of the valves illustrated. See, for instance, the valve of the above identified Taylor patent which in one form can be releasably moved between latched and unlatched position.

This invention may be found to be particularly advantageous in applications where tubing pressure is isolated from the control pressure by more than the seal across the operating piston. For instance, see U.S. Pat. No. 4,294,315 in which the operating piston is isolated from tubing pressure. By isolating the operating piston from tubing pressure, at least in the secondary valve form of the system, the differential across the operating piston could be reduced to substantially zero minimizing the possibility of damage and deterioration of the seal prior to the time that the secondary valve is placed in operation.

While three control lines are illustrated, lines 24 and 25 could be a common control line as it is desired to lock the primary valve open when the secondary valve is operated. After the primary valve is locked open the piston will remain down and changing pressure on piston 13 will have no effect.

The foregoing disclosure and description of the invention is illustrative and explanatory thereof and various changes in the method, size, shape and materials, as well as in the details of the illustrated construction, may be made within the scope of the appended claims without departing from the spirit of the invention.

What is claimed is:

1. A surface controlled subsurface safety valve comprising, a tubular body, a valve member controlling flow through the body, a valve operator for moving said valve member between open and closed positions, a pressure responsive member carried by said operator for moving said operator to open position when subjected to a selected fluid pressure, and means releasably securing said valve operator in position maintaining said valve member in non-closed position, said securing means releasing said operator in response to movement of said pressure responsive member toward valve opening position to place said valve in service.

2. The valve of claim 1 wherein said securing means is a C-ring which is released upon movement of said pressure responsive member toward valve opening position.

3. The valve of claim 1 or 2 in combination with a tubing connected to the valve, a second subsurface safety valve connected to said well tubing, separate control lines extending along said tubing from the two valves to means for selectively pressurizing said control lines and controlling said pressure, said second safety valve having means for latching the second safety valve in open position upon malfunction of the valve, whereby said safety valve may remain in non-closed position and flow through the tubing be controlled by said second safety valve until said second safety valve is latched in open position and said safety valve activated by applying pressure to said pressure responsive member to release the valve operator and place said safety valve in service.

* * * * *